US007849767B1

(12) United States Patent
Wessel, IV

(10) Patent No.: US 7,849,767 B1
(45) Date of Patent: Dec. 14, 2010

(54) CONNECTORS FOR A WRENCH ASSEMBLY

(76) Inventor: Homer A. Wessel, IV, 148 Bilboa St., Royal Palm Beach, FL (US) 33411

( * ) Notice: Subject to any disclaimer, the term of this patent is extended or adjusted under 35 U.S.C. 154(b) by 169 days.

(21) Appl. No.: 12/172,670

(22) Filed: Jul. 14, 2008

Related U.S. Application Data

(60) Continuation-in-part of application No. 11/874,573, filed on Oct. 18, 2007, now abandoned, and a division of application No. 11/034,095, filed on Jan. 11, 2005, now Pat. No. 7,299,723.

(51) Int. Cl.
*B25G 3/00* (2006.01)
*B25B 23/00* (2006.01)

(52) U.S. Cl. ..... 81/177.2

(58) Field of Classification Search ..... 81/177.2, 81/177.85, 119, 124.5, 125.1, 180.1; D8/27, D8/29

See application file for complete search history.

(56) References Cited

U.S. PATENT DOCUMENTS

| | | | | | |
|---|---|---|---|---|---|
| 1,054,687 | A | | 3/1913 | Grigg | |
| D115,301 | S | | 6/1939 | Spexarth | |
| 2,708,855 | A | | 5/1955 | Fish | |
| 2,715,347 | A | | 8/1955 | Johnson | |
| 3,039,339 | A | * | 6/1962 | Hanson | 81/177.2 |
| 3,188,895 | A | | 6/1965 | Jones | |
| 3,376,768 | A | * | 4/1968 | Fortunato | 81/177.2 |
| 3,996,821 | A | * | 12/1976 | Murray | 81/177.2 |
| D257,319 | S | * | 10/1980 | Cremer | D8/29 |
| 4,596,167 | A | * | 6/1986 | White, Jr. | 81/177.2 |
| 4,811,638 | A | | 3/1989 | Kertzcher | |
| 4,967,612 | A | | 11/1990 | Sparling | |
| 5,131,300 | A | | 7/1992 | Daniel | |
| 5,485,769 | A | * | 1/1996 | Olson et al. | 81/177.85 |
| 5,582,083 | A | | 12/1996 | Baker | |
| 6,092,441 | A | | 7/2000 | Jarvis | |
| D433,895 | S | | 11/2000 | Kindel | |
| D442,041 | S | | 5/2001 | Chen | |
| D473,768 | S | | 4/2003 | Gilmore | |
| 6,550,358 | B1 | | 4/2003 | Martin | |
| 7,182,000 | B1 | * | 2/2007 | Dicksen | 81/177.2 |
| 7,299,723 | B1 | * | 11/2007 | Wessel, IV | 81/177.2 |
| 2004/0099100 | A1 | * | 5/2004 | Hu | 81/119 |

* cited by examiner

*Primary Examiner*—David B Thomas
(74) *Attorney, Agent, or Firm*—Gold & Rizvi, P.A.; Glenn E. Gold; H. John Rizvi

(57) ABSTRACT

Connectors capable of connecting socket and/or ratchet elements in a wrench assembly in such a manner that a nut- or bolt-engaging member at one end of the assembly is disposed at a selected position or orientation with respect to a handle at the opposite end of the assembly. The connectors include a variety of connectors characterized by male and female connector elements disposed in generally perpendicular relationship to each other. The connectors further include parallel offset connectors in which male and female connector elements are disposed in offset, parallel relationship to each other. The male and female connector elements are capable of removably engaging companion female and male connector elements, respectively, of various socket and/or ratchet elements to assemble the wrench assembly and facilitate positioning of a wrench handle at one end of the wrench assembly at a selected orientation with respect to a nut- or bolt-engaging element at the opposite end of the assembly. A connector optionally includes a sliding interface providing an adjusting span between the male and female connector elements.

14 Claims, 16 Drawing Sheets

CONNECTORS FOR A WRENCH ASSEMBLY

CROSS-REFERENCE TO RELATED APPLICATION

This application is a Continuation-In-Part application co-pending U.S. Non-Provisional patent application Ser. No. 11/874,573, filed on Oct. 18, 2007, which is a divisional application and was of U.S. Non-Provisional patent application Ser. No. 11/034,095, filed on Jan. 11, 2005 (now issued U.S. Pat. No. 7,299,723, issued on Nov. 7, 2005), and, which are all incorporated herein in their entirety.

FIELD OF THE INVENTION

The present invention relates generally to connectors used to connect various socket and/or ratchet elements together in a wrench assembly for the loosening and tightening of nuts and/or bolts in inaccessible locations. More particularly, the present invention relates to novel ninety-degree and parallel-offset connectors, which facilitate various ninety-degree connections between socket and/or ratchet elements in a wrench assembly to achieve versatility in accessing nuts and/or bolts in inaccessible locations.

BACKGROUND OF THE INVENTION

Various types of tools exist for the tightening and loosening of nuts, bolts and other fasteners. These include both manually actuated and automated screwdrivers, as well as various types of wrenches. One of the most common types of wrenches is the crescent wrench, which includes an elongated handle with a C-shaped wrench head on one end. In use, a nut or bolt is inserted between the opposing flanges of the wrench head, such that the flanges engage the flat surfaces on the nut or bolt. The wrench is turned in a clockwise direction to tighten the bolt or nut and in a counterclockwise direction to loosen the bolt or nut.

A more complex type of wrench, which is widely used in various mechanical applications, is the socket wrench. A socket wrench includes an elongated handle fitted with a ratchet assembly on one end. Cylindrical sockets of various sizes are removably attached to a male connector element on the ratchet assembly. Each socket is provided with multiple interior ridges or teeth for engaging the flats on a bolt or nut. A directional selector is provided on the ratchet assembly to select the direction of rotation of the socket, for incremental tightening or loosening of the bolt or nut, when the socket is attached to the ratchet assembly. The socket wrench imparts ease, convenience and flexibility to the bolt or nut tightening and loosening procedure, since there is no need to disengage and re-engage the socket with respect to the bolt or nut each time positional re-adjustment of the wrench handle is necessary during tightening or loosening.

A common drawback associated with conventional crescent and socket wrenches is the difficulty, which is often encountered in accessing bolts or nuts in enclosed or inaccessible areas. Crescent wrenches are typically capable of engaging the flats on a bolt or nut only as long as the longitudinal axis of the wrench handle is disposed in the plane of the bolt or nut. With regard to socket wrenches, the socket attached to the ratchet assembly is typically disposed at a ninety-degree angle with respect to the wrench handle. Therefore, sufficient clearance must exist between the ratchet assembly of the wrench and the bolt or nut to be tightened or loosened to facilitate proper engagement of the socket with the bolt or nut. Furthermore, sufficient clearance must exist between the throws of the wrench handle to facilitate a full range of back-and-forth movement of the handle as the ratchet assembly rotates the socket.

Various types of wrenches and wrench attachments are known in the U.S. patent literature. For example, U.S. Pat. No. 1,054,687 discloses a wrench, which includes an elongated handle from which extends a shaft. A shank is mounted on the shaft, and a nut-engaging member is provided on the shank. The nut-engaging member is capable of receiving a hex-headed nut in such a manner that the handle can be rotated along an arc of rotation disposed within the plane of the nut. However, as the nut-engaging member is disposed in fixed relationship to the handle, the wrench of the '687 patent does not include various connectors, which can be incorporated between the handle and the nut-engaging member to facilitate multi-directional positioning of the handle with respect to the nut.

U.S. Pat. Nos. 2,669,147; 2,708,855; and 2,715,347 disclose wrenches each having a handle pivotally attached to an engaging member for engaging a nut or bolt. However, the wrenches disclosed in those patents provide only a single positional adjustment point between the engaging member and the handle.

U.S. Pat. No. 6,550,358 discloses a wrench adaptor, which includes an elongated portion having a rectangular opening provided in a flange at one end for receiving a male connector element on a socket wrench and an Allen wrench receptacle in the other end for receiving an Allen wrench. The wrench adaptor is capable of providing a parallel connection between the handle of the socket wrench and an Allen screw when the Allen wrench is inserted in the Allen screw. However, the wrench adaptor as disclosed is incapable of providing multi-directional attachment capability between a wrench handle and a nut or bolt to be tightened or loosened in order to facilitate access to nuts and bolts in hard-to-reach areas.

Additional wrenches and wrench heads, all of which are incapable of providing multi-directional positioning capability of a wrench handle with respect to an engaging member for engaging a nut or bolt, are disclosed in U.S. Pat. Nos. D115,301; D433,895; D442,041; D473,768; 3,188,895; 4,811,638; 4,967,612; 5,131,300; and 5,582,083; and U.S. Statutory Invention Reg. No. H1689.

Accordingly, there is a need for connectors, which are capable of connecting a nut- or bolt-engaging member to a handle in various orientations and configurations to facilitate tightening and/or loosening a nut or bolt located in inaccessible areas.

SUMMARY OF THE INVENTION

The invention is directed to ninety-degree and parallel offset connectors which are capable of connecting various socket and/or ratchet elements in a wrench assembly in such a manner that a nut- or bolt-engaging member at one end of the assembly is disposed at a selected position or orientation with respect to a handle at the opposite end of the assembly. The ninety-degree connectors impart versatility to the wrench assembly in accessing nuts and bolts in hard-to-reach areas, such as between adjacent flanges of a U-shaped bracket or in partially-enclosed areas, which are difficult or impossible to access using conventional wrenches, for example. Each ninety-degree connector is broadly characterized by male and female connector elements that are disposed in generally perpendicular relationship to each other. Each parallel offset connector is broadly characterized by male and female connector elements, which are disposed in generally, offset, parallel relationship to each other. The male and female connector elements are capable of removably engaging companion female and male connector elements, respectively, of various socket and/or ratchet elements to assemble the wrench assembly and facilitate positioning of a wrench handle at one end of the wrench assembly at a selected orientation with respect to a nut- or bolt-engaging element at the opposite end of the wrench assembly.

In one general aspect of the present invention, a ninety-degree connector is provided for facilitating ninety-degree connection between adjacent ones of the socket and/or ratchet elements in the wrench assembly. The ninety-degree connector typically comprises:

a generally rectangular connector body having a female connector opening; and a male connector element extending from the connector body and provided in generally perpendicular relationship to the connector opening.

In a further aspect of the present invention, the ninety-degree connector includes a curved connector body having a male connector element on one end and a female connector element having a connector opening disposed in generally perpendicular relationship to the male connector element on the other end.

In still a further aspect of the present invention, the ninety-degree connector includes an elongated connector body having a female connector opening provided in the connector body, adjacent to one end thereof and a male connector element extending from the connector body, adjacent to the opposite end thereof.

In yet another aspect of the present invention, the ninety-degree connector includes an elongated connector body having a female connector opening provided in the connector body, adjacent to one end thereof; a male connector receptacle opening provided in the connector body, adjacent to the opposite end thereof; and a male connector element which is removably fitted in the male connector receptacle opening.

In another aspect of the present invention, the ninety-degree connectors are capable of connecting a conventional socket wrench having a wrench handle at one end of a wrench assembly to a conventional socket at the opposite end of the wrench assembly in order to facilitate positioning of the wrench handle at a selected configuration with respect to the socket.

In a still further aspect of the present invention, the ninety-degree connectors are capable of being used in combination with various conventional socket and/or ratchet assemblies to connect a socket wrench having a wrench handle to a conventional socket which engages a nut or bolt in order to facilitate tightening and/or loosening of a nut or bolt located in an inaccessible location.

In another aspect of the present invention, the parallel-offset connectors include an elongated connector body, a female connector opening provided in the connector body adjacent to one end thereof and a male connector element provided on the connector body adjacent to the opposite end thereof, with the male connector element disposed in substantially parallel relationship to the female connector opening.

In yet another aspect, the offset connector comprises a elongated planar connector body having a male connector element extending from a position adjacent to a first end of the connector body and a female connector opening located adjacent an opposing end.

With another aspect providing a female connector bossing extending from the elongated planar connector body, positioned about the female connector opening.

Having another providing the male connector element with a height from an upper surface of the elongated planar connector body that is slightly greater than a similar height of the female connector bossing. The preferred difference being the substantially the thickness of the elongated planar connector body.

While another aspect incorporates the male connector element onto a elongated sliding connector body which is slideably engaged with the elongated planar connector body, providing an adjusting span between the male connector element and the female connector opening.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Shown throughout the Figures, the present invention is generally directed to various ninety-degree connectors and parallel offset connectors which are capable of connecting various socket wrench, socket, auxiliary wrench extension and/or ratchet elements in a wrench assembly in such a manner that a nut- or bolt-engaging member at one end of the assembly is disposed at a selected position or orientation with respect to a handle at the opposite end of the assembly. The connectors impart versatility to the wrench assembly in accessing nuts and bolts for tightening and/or loosening in hard-to-reach areas, such as between adjacent flanges of a U-shaped bracket or in partially-enclosed areas, which are difficult or impossible to access using conventional wrenches, for example.

Figure 1:
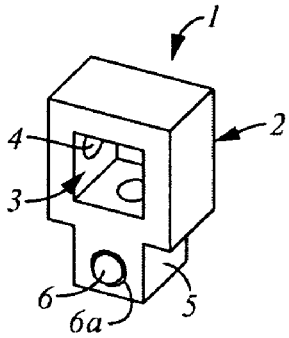
FIG. 1 is a front perspective view of a ninety-degree connector according to a preferred embodiment of the invention.

Referring initially to FIG. 1, a preferred embodiment of the ninety-degree connectors of the present invention is generally indicated by reference numeral 1. The ninety-degree connector 1 includes a connector body 2 which may be generally rectangular in shape, as shown. A female connector opening 3, which is typically rectangular in shape, extends through the connector body 2. Multiple depressions 4 are typically provided in two or more of the interior walls, respectively, of the female connector opening 3, for purposes, which will be hereinafter described. A male connector element 5, which typically has a generally rectangular cross-section, extends from the connector body 2, in generally perpendicular relationship to the female connector opening 3. Ball bearings 6 (one of which is shown) typically extend from ball bearing openings **6*a* provided in opposite surfaces of the male connector element 5** for purposes, which will be hereinafter described.

Figure 2:
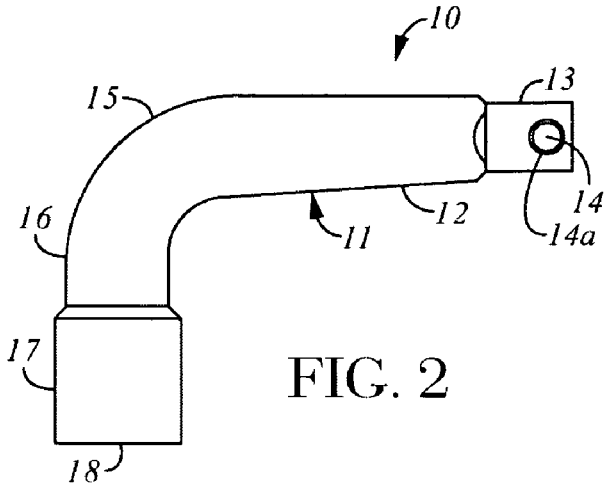
FIG. 2 is a side view of a ninety-degree connector according to another embodiment of the invention.

Referring next to FIG. 2, another embodiment of the ninety-degree connectors of the present invention is generally indicated by reference numeral 10. The ninety-degree connector 10 includes a curved connector body 11 which typically includes an elongated male connector segment 12, a bend 15 which extends from the male connector segment 12 and a female connector segment 16 which extends from the bend 15. Accordingly, the female connector segment 16 is disposed in substantially perpendicular relationship to the male connector segment 12. A male connector element 13 is provided on the end of the male connector segment 12 and typically has a rectangular cross-sectional configuration. A pair of ball bearings 14 (one of which is shown) is seated in respective ball bearing openings **14*a* provided in opposite surfaces of the male connector element 13. A female connector element 17, having a female connector opening 18, is provided on the end of the female connector segment 16**.

Figure 3:
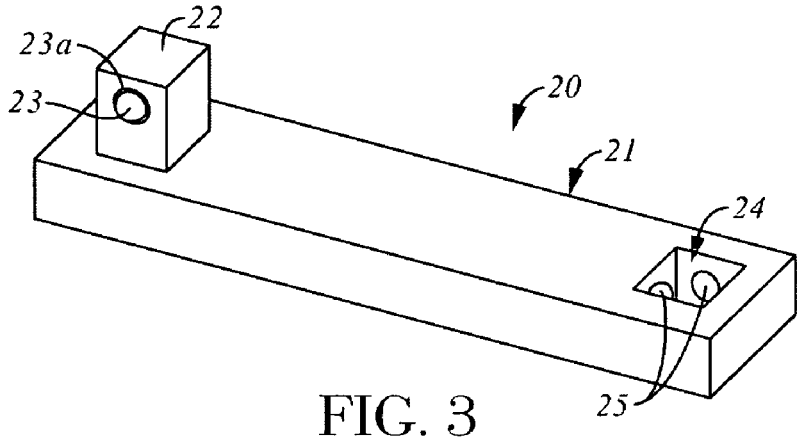
FIG. 3 is a perspective view of a parallel offset connector according to still another embodiment of the invention.

Referring next to FIG. 3, a parallel offset connector 20 according to still another embodiment of the invention is generally indicated by reference numeral 20. The parallel offset connector 20 includes an elongated connector body 21, which may be generally rectangular in configuration. A male connector element 22, which typically includes a pair of ball bearings 23 (one of which is shown) seated in respective ball bearing openings **23*a* in opposite surfaces of the male connector element 22, extends from the connector body 21, adjacent to one end thereof. A female connector opening 24, which is typically rectangular, is provided in the connector body 21, adjacent to the opposite end of the connector body 21. Multiple depressions 25, the purpose of which will be hereinafter described, are typically provided in the respective interior surfaces of the female connector opening 24**.

Figure 4:
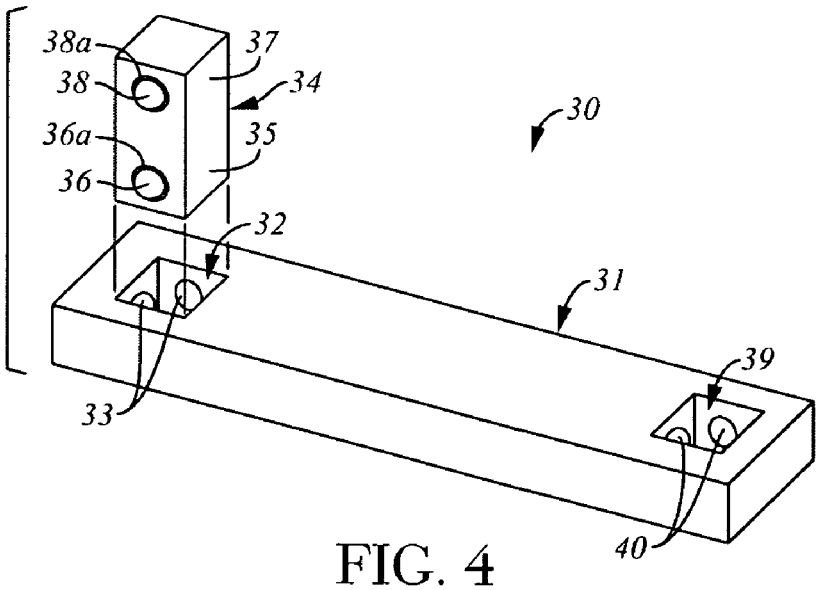
FIG. 4 is a perspective view of an alternative embodiment of the parallel offset connector shown in FIG. 3, which parallel offset connector includes a male connector element which removably engages a connector body through a snap-fit.

Referring next to FIG. 4, another embodiment of the parallel offset connector of the present invention is generally indicated by reference numeral 30. The parallel offset connector 30 is an alternative embodiment of the parallel offset connector 20 of FIG. 3 and includes an elongated connector body 31, which may be rectangular. A male connector receptacle opening 32 is provided in the connector body 31, adjacent to one end thereof. Multiple depressions 33 are typically provided in respective interior surfaces of the male connector receptacle opening 32. A male connector element 34 includes an insertion portion 35 which is fitted with a pair of ball bearings 36 (one of which is shown) seated in respective ball bearing openings **36*a* provided in opposite surfaces of the insertion portion 35. Accordingly, the insertion portion 35 is removably inserted in the male connector receptacle opening 32 to mount the male connector element 34 in the male connector receptacle opening 32, with the extension portion 37 extending beyond the plane of the connector body 31. The ball bearings 36 snap into the respective depressions 33 in the male connector receptacle opening 32 to secure the male connector element 34 to the connector body 31. The extension portion 37 of the male connector element 34 is fitted with a pair of ball bearings 38 (one of which is shown) seated in respective ball bearing openings 38*a* provided in opposite surfaces of the extension portion 37. A female connector opening 39 is provided in the connector body 31, adjacent to the opposite end of the connector body 31. Multiple depressions 40 are provided in respective interior surfaces of the female connector opening 39** for purposes, which will be hereinafter described.

Figure 5:
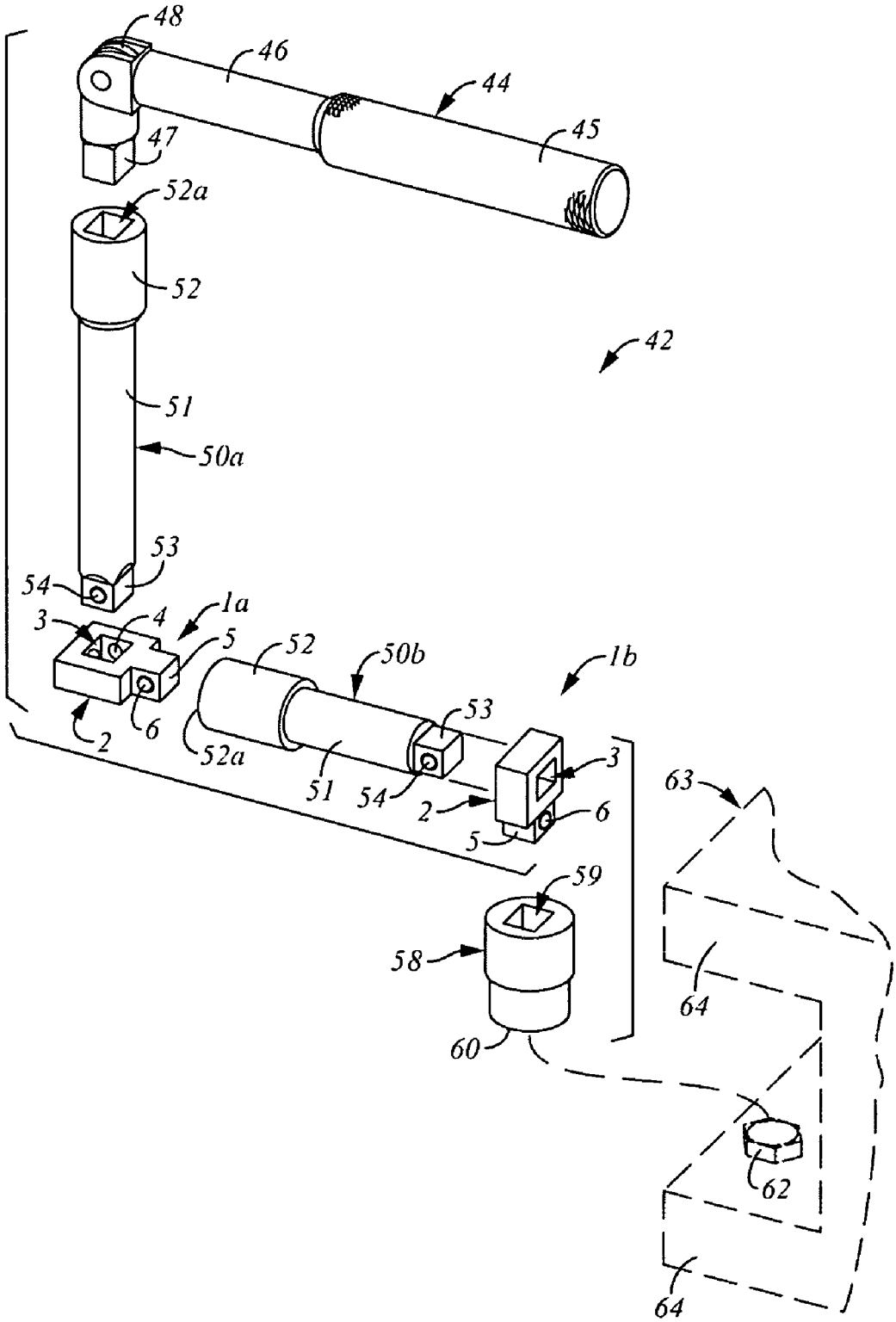
FIG. 5 is an exploded, perspective view of an illustrative wrench assembly which incorporates multiple ninety-degree connectors of the embodiment shown in FIG. 1, in combination with a conventional socket wrench, socket and auxiliary wrench extension elements, to access a bolt between adjacent vertically-spaced flanges of a bracket.

Referring next to FIG. 5, an illustrative wrench assembly 42 is shown which incorporates a pair of ninety-degree connectors 1*a* and 1*b*, respectively, heretofore described with respect to FIG. 1. The wrench assembly 42 is used to loosen and/or tighten the head of a bolt 62 between a pair of closely-spaced bolt flanges 64 of a bracket 63 (shown in phantom). The wrench assembly 42 typically includes a socket wrench 44 which may be conventional and includes a handle 45, a shaft 46 which extends from the handle 45 and a male connector element 47 which is connected to the shaft 46 through a hinge 48. The wrench assembly 42 typically further includes a pair of conventional auxiliary wrench extensions 50*a* and 50*b*, respectively, each of which has an elongated shaft 51; a female connector element 52 having a socket 52*a* on one end of the shaft 51; and a male connector element 53 having a pair of exterior ball bearings 54 (one of which is shown) on the opposite end of the shaft 51. Finally, the wrench assembly 42 typically includes a conventional socket 58 having a female connector opening 59 in one end and a socket opening 60 in the opposite end for engaging the bolt 62.

The wrench assembly 42 is assembled by snap-fitting the male connector element 47 of the socket wrench 44 into the socket 52*a* of an auxiliary wrench extension 50*a*; snap-fitting the male connector element 53 of the auxiliary wrench extension 50*a* into the female connector opening 3 of a ninety-degree connector 1*a*, such that the ball bearings 54 snap into the respective depressions 4 inside the female connector opening 3; snap-fitting the male connector element 5 of the ninety-degree connector 1*a* into the socket 52*a* of the auxiliary wrench extension 50*b*, such that the ball bearings 6 snap into respective depressions (not shown) in the socket 52*a*; snap-fitting the male connector element 53 of the auxiliary wrench extension 50*b* into the female connector opening 3 of the second ninety-degree connector 1*b*, such that the ball bearings 54 snap into the respective depressions 4 in the female connector opening 3; and snap-fitting the male connector element 5 into the female connector opening 59 of the conventional socket 58. Therefore, the connector 1*a* facilitates a ninety-degree change in direction between the auxiliary wrench extension 50*a* and the auxiliary wrench extension 50*b*, whereas the connector 1*b* facilitates a ninety-degree change in direction between the auxiliary wrench extension 50*b* and the socket 58.

In use, the bolt 62 is inserted in the socket opening 60 of the socket 58. The handle 45 of the socket wrench 44 can be grasped from the side of the bracket 63 which is opposite the flanges 64 thereof, to facilitate tightening and/or loosening of the bolt 62 by movement of the handle 45 in an arcuate motion in the clockwise direction (to tighten the bolt 62) and in the counterclockwise direction (to loosen the bolt 62).

Figure 6:
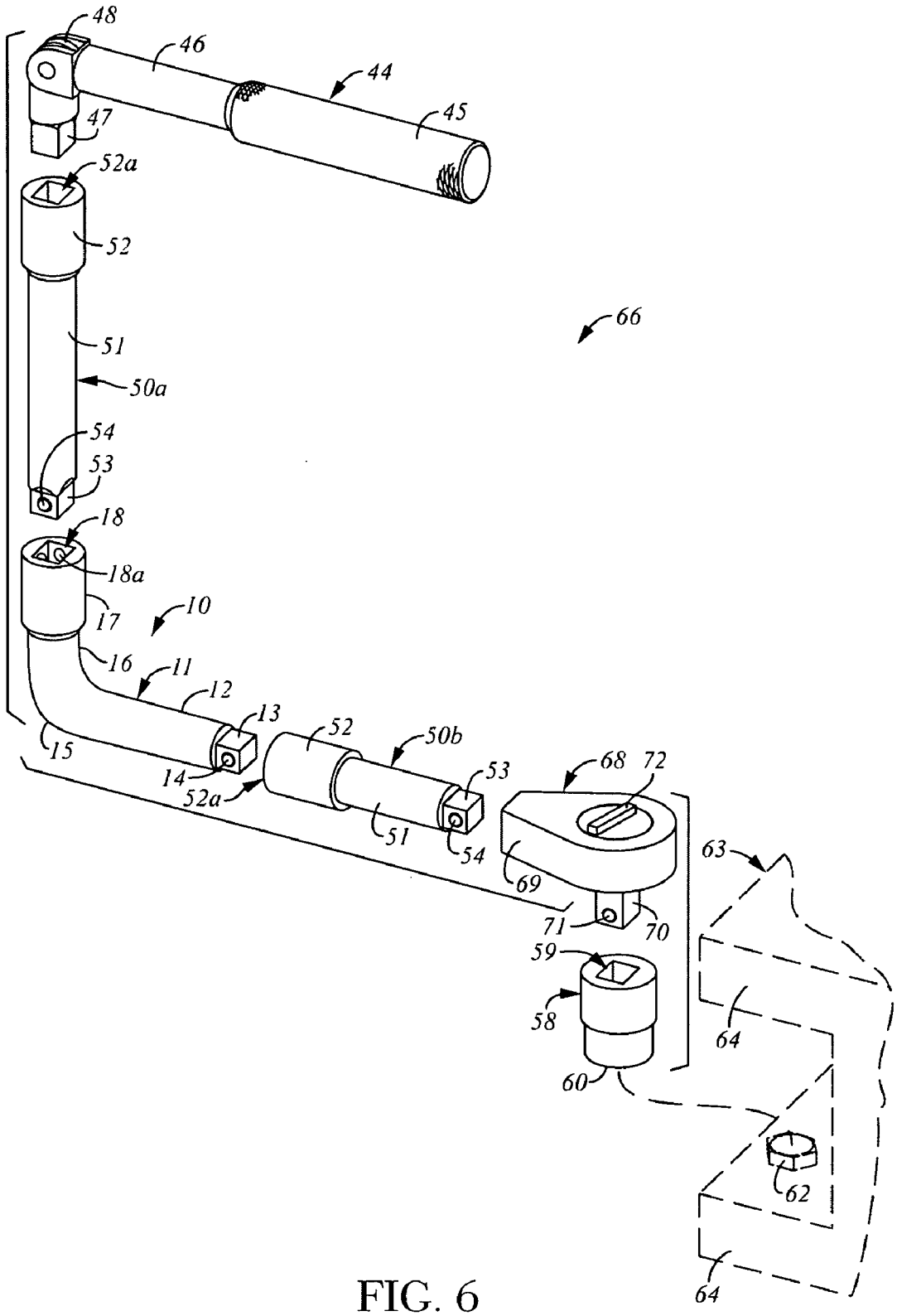
FIG. 6 is an exploded, perspective view of another illustrative wrench assembly which incorporates multiple ninety-degree connectors of the embodiment shown in FIG. 2, in combination with a conventional socket wrench, socket, ratchet assembly and auxiliary wrench extension elements, to access a bolt between adjacent vertically-spaced flanges of a bracket.

Referring next to FIG. 6, another illustrative wrench assembly 66 is shown which incorporates a ninety-degree connector 10 heretofore described with respect to FIG. 2. The wrench assembly 66 typically includes a socket wrench 44, which may be conventional; a pair of conventional auxiliary wrench extensions 50*a* and 50*b*, respectively; a ratchet assembly 68, which may be conventional and typically includes a female connector element 69, a male connector element 70 having a pair of ball bearings 71 and a directional selector 72; and a conventional socket 58.

The wrench assembly 66 is assembled by snap-fitting the male connector element 47 of the socket wrench 44 into the socket 52*a* of the auxiliary wrench extension 50*a*; snap-fitting the male connector element 53 of the auxiliary wrench extension 50*a* into the socket opening 18 of the ninety-degree connector 10, such that the ball bearings 54 snap into the respective depressions 18*a* inside the socket opening 18; snap-fitting the male connector element 13 of the ninety-degree connector 10 into the socket 52*a* of the auxiliary wrench extension 50*b*, such that the ball bearings 14 snap into respective depressions (not shown) in the socket 52*a*; snap-fitting the male connector element 53 of the auxiliary wrench extension 50*b* into the female connector element 69 of the ratchet assembly 68, such that the ball bearings 54 snap into respective depressions (not shown) in the female connector element 69; and snap-fitting the male connector element 70 into the female connector opening 59 of the conventional socket 58. Therefore, the connector 10 facilitates a ninety-degree change in direction between the auxiliary wrench extension 50*a* and the auxiliary wrench extension 50*b*.

In use, the bolt 62 is inserted in the socket opening 60 of the socket 58. The handle 45 of the socket wrench 44 can be grasped from the side of the bracket 63 which is opposite the flanges 64 thereof, to facilitate tightening and/or loosening of the bolt 62 by moving the handle 45 of the socket wrench 44 in an arcuate, back-and-forth motion, with the tightening or loosening of the bolt 62 depending on the position of the directional selector 72 of the ratchet assembly 68.

Figure 7:
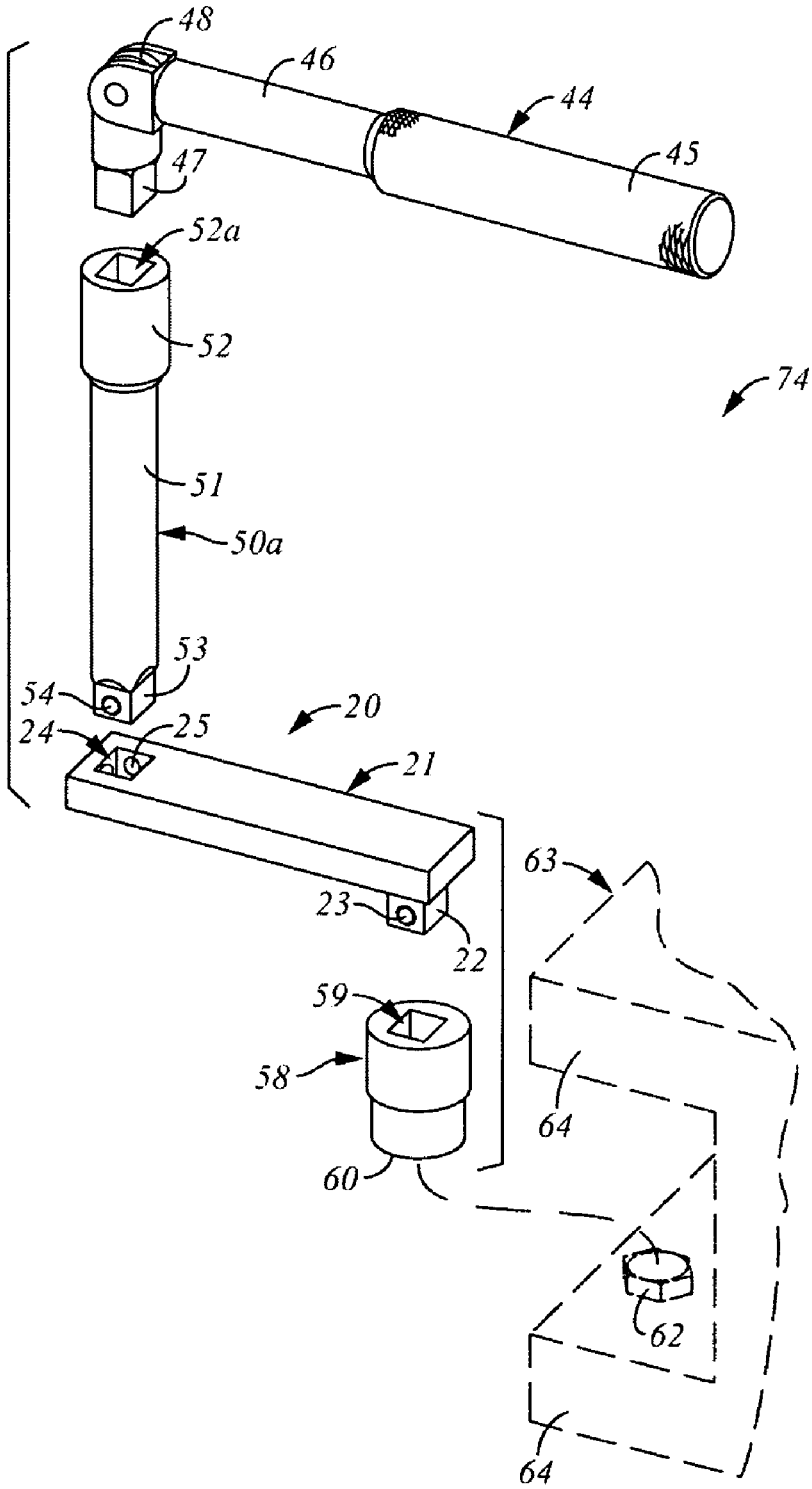
FIG. 7 is an exploded, perspective view of still another illustrative wrench assembly which incorporates a ninety-degree connector of the embodiment shown in FIG. 3, in combination with a conventional socket wrench, socket and auxiliary wrench extension elements, to access a bolt between adjacent vertically-spaced flanges of a bracket.

Referring next to FIG. 7, still another illustrative wrench assembly 74 is shown which incorporates a parallel offset connector 20 heretofore described with respect to FIG. 3. The wrench assembly 74 typically includes a conventional socket wrench 44; a conventional auxiliary wrench extension 50; the parallel offset connector 20; and a conventional socket 58.

The wrench assembly 74 is assembled by snap-fitting the male connector element 47 of the socket wrench 44 into the socket 52*a* of the auxiliary wrench extension 50; snap-fitting the male connector element 53 of the auxiliary wrench extension 50 into the female connector opening 24 of the parallel offset connector 20, such that the ball bearings 54 snap into the respective depressions 25 inside the female connector opening 24; and snap-fitting the male connector element 22 of the parallel offset connector 20 into the female connector opening 59 of the conventional socket 58. Therefore, the connector 20 facilitates a parallel offset between the auxiliary wrench extension 50 and the socket 58.

In use, the bolt 62 is inserted in the socket opening (not shown) of the socket 58. Accordingly, the handle 45 of the socket wrench 44 can be grasped from the side of the bracket 63 which is opposite the flanges 64 thereof, to facilitate tightening and/or loosening of the bolt 62 by moving the handle 45 of the socket wrench 44 in an arcuate motion in a clockwise direction to tighten the bolt 62 and in a counterclockwise direction to loosen the bolt 62.

Figure 8:
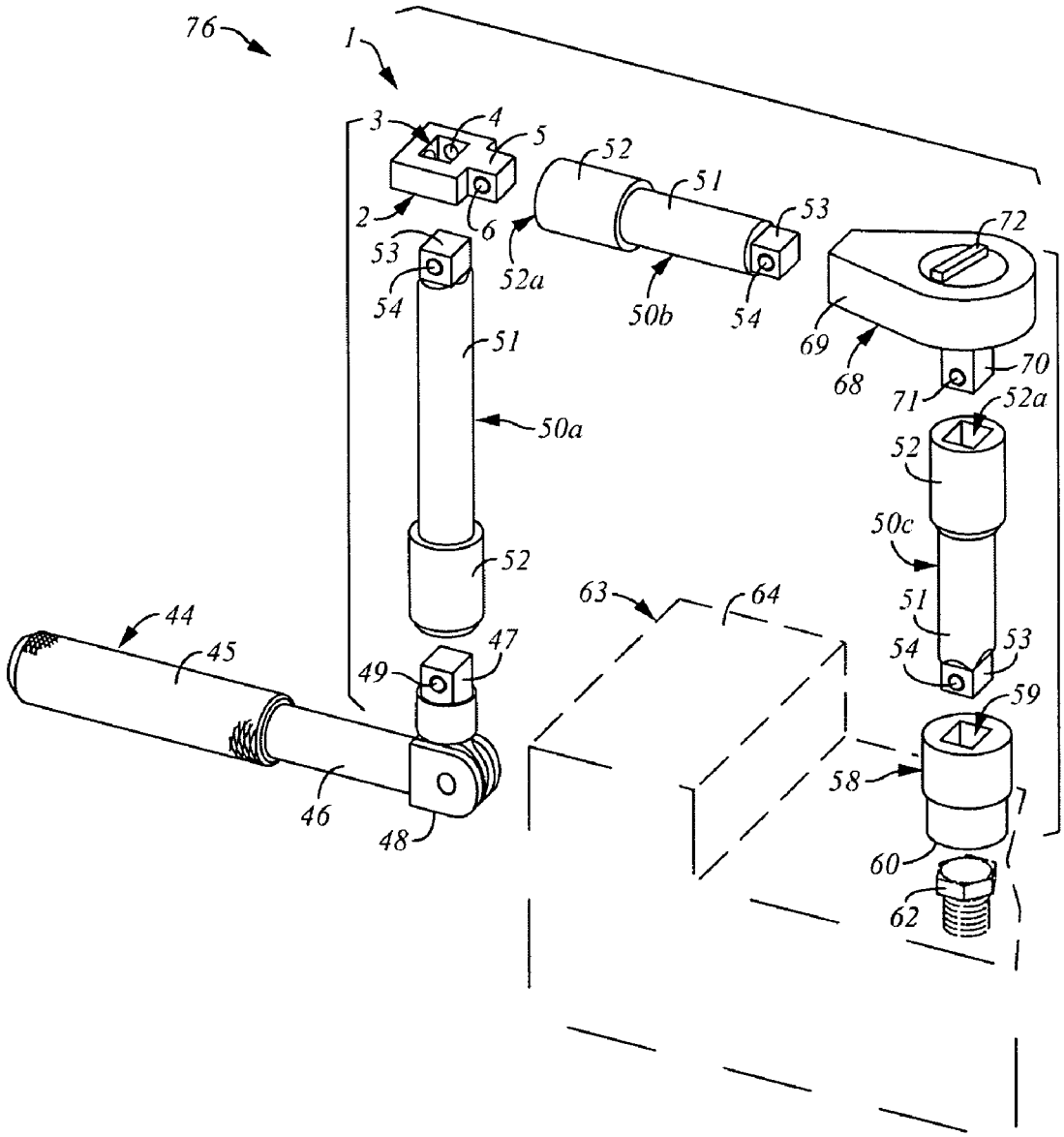
FIG. 8 is an exploded, perspective view of yet another illustrative wrench assembly which incorporates a ninety-degree connector of the embodiment shown in FIG. 1, in combination with a conventional socket wrench, socket, auxiliary wrench extension and ratchet assembly elements, to access a bolt between adjacent horizontally-spaced flanges (one of which is illustrated) of a bracket.

Referring next to FIG. 8, yet another illustrative wrench assembly 76 is shown which incorporates a ninety-degree connector 1 heretofore described with respect to FIG. 1. The wrench assembly 76 can be used to access a bolt 62, which is provided between a pair of horizontally-spaced flanges 64 (one of which is shown) of a bracket 63, for example. The wrench assembly 76 typically includes a socket wrench 44; three conventional auxiliary wrench extensions 50*a*, 50*b* and 50*c*, respectively; a ratchet assembly 68, which may be conventional; and a conventional socket 58.

The wrench assembly 76 is assembled by inserting the male connector element 47 of the socket wrench 44 into the socket 52*a* of the auxiliary wrench extension 50*a*; inserting the male connector element 53 of the auxiliary wrench extension 50*a* into the female connector opening 3 of a ninety-degree connector 1, such that the ball bearings 54 snap into the respective depressions 4 inside the female connector opening 3; inserting the male connector element 5 of the ninety-degree connector 1 into the socket 52*a* of the auxiliary wrench extension 50*b*, such that the ball bearings 6 snap into respective depressions (not shown) in the socket 52*a*; inserting the male connector element 53 of the auxiliary wrench extension 50*b* into the female connector element 69 of the ratchet assembly 68, such that the ball bearings 54 snap into respective depressions (not shown) in the female connector element 69; inserting the male connector element 70 into the female connector element 52*a* of the auxiliary wrench extension 50*c*; and inserting the male connector element 53 into the female connector opening 59 of the socket 58. Thus, the connector 1 facilitates a ninety-degree change in direction between the auxiliary wrench extension 50*a* and the auxiliary wrench extension 50*b*.

Figure 9:
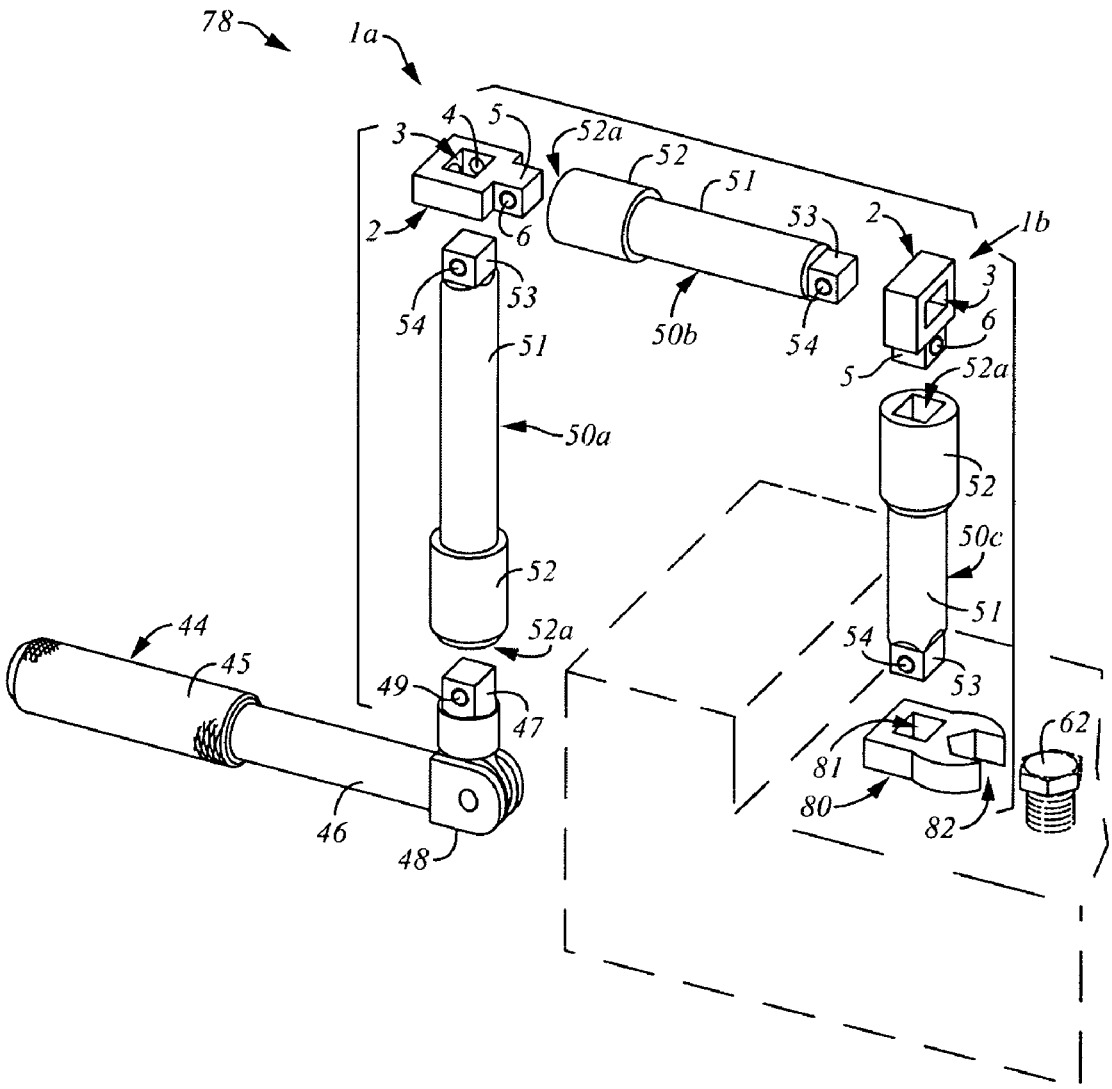
FIG. 9 an exploded, perspective view of another illustrative wrench assembly which incorporates multiple ninety-degree connectors of the embodiment shown in FIG. 1, in combination with a conventional socket wrench and auxiliary wrench extension elements and a conventional crow foot wrench, to access a bolt between adjacent flanges of a horizontal bracket.
Figure 10:
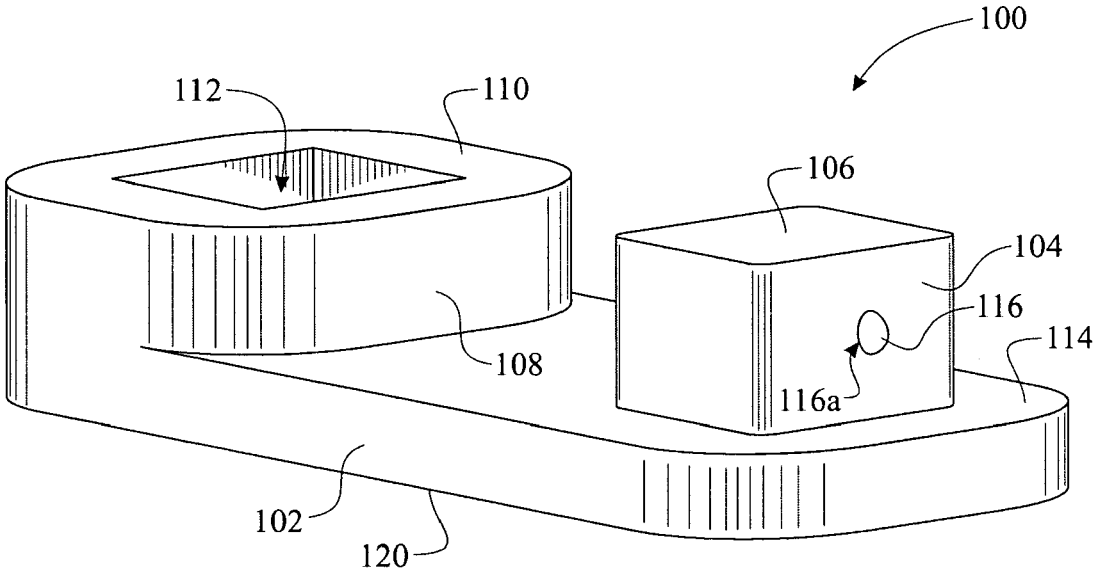
FIG. 10 is a perspective view of an enhanced parallel offset connector according to still another embodiment of the invention.
Figure 12:
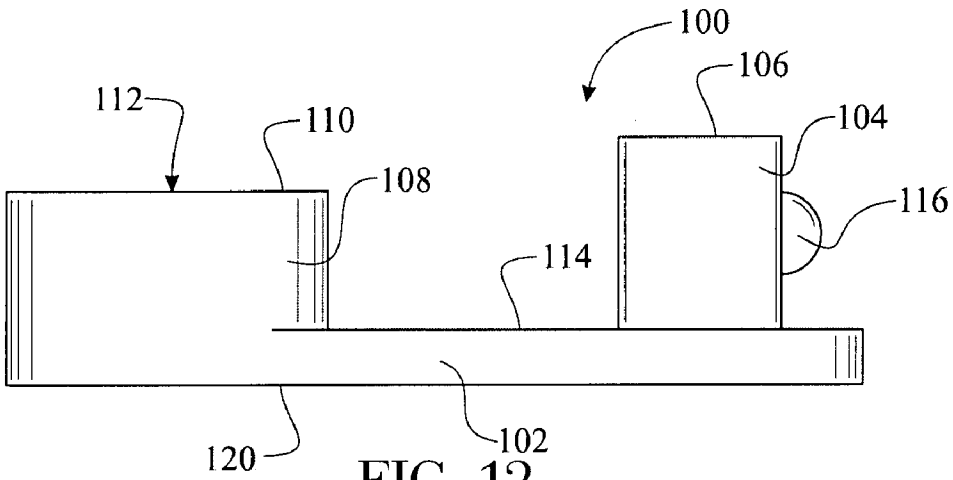
FIG. 12 is a right side elevation view of the enhanced parallel offset connector presented in FIG. 10.
Figure 11:
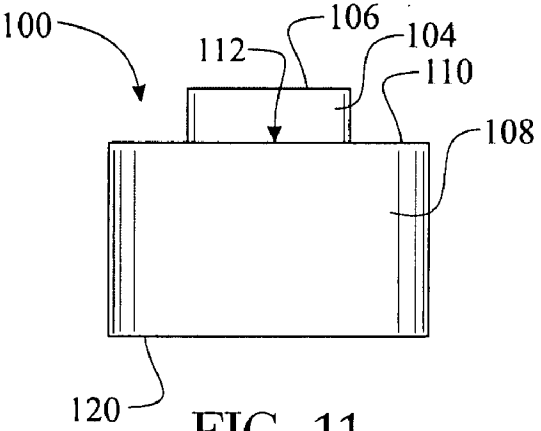
FIG. 11 is a rear elevation view of the enhanced parallel offset connector presented in FIG. 10.
Figure 14:
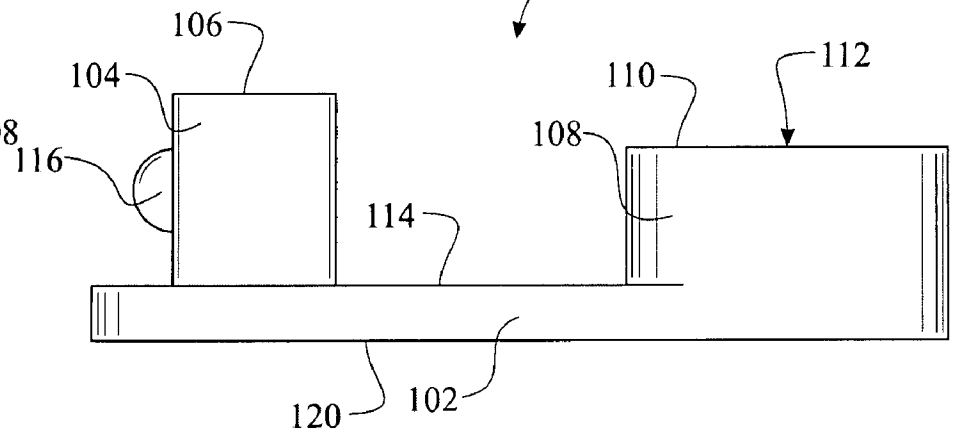
FIG. 14 is a left side elevation view of the enhanced parallel offset connector presented in FIG. 10.
Figure 13:
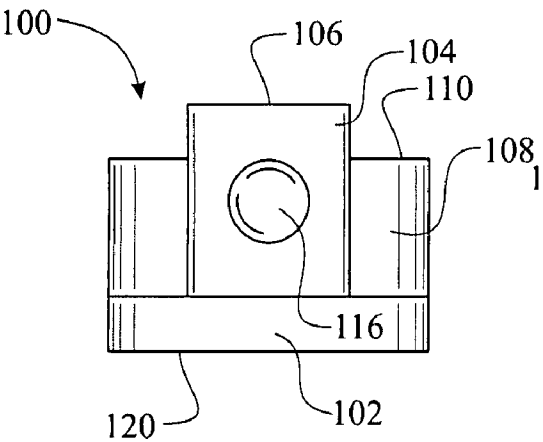
FIG. 13 is a front elevation view of the enhanced parallel offset connector presented in FIG. 10.

In use, the bolt 62 is inserted in the socket opening 60 of the socket 58. Accordingly, the handle 45 of the socket wrench 44 can be grasped from the side of the bracket 63 which to the side of one of the flanges 64 thereof, to facilitate tightening and/or loosening of the bolt 62 by moving the handle 45 of the socket wrench 44 in a back-and-forth, arcuate motion Referring next to FIG. 9, still another illustrative wrench assembly 78 is shown which incorporates two ninety-degree connectors 1*a* and 1*b*, respectively, heretofore described with respect to FIG. 1. The wrench assembly 78 can be used to access a bolt 62, which is provided between a pair of horizontally-spaced flanges 64 (one of which is shown) of a bracket 63, for example. The wrench assembly 78 typically includes a socket wrench 44; three auxiliary wrench extensions 50*a*, 50*b* and 50*c*, respectively; and a conventional crowfeet wrench 80, which typically includes a female connector opening 81 and a bolt receptacle 82.

The wrench assembly 78 is assembled by snap-fitting the male connector element 47 of the socket wrench 44 into the socket 52*a* of the auxiliary wrench extension 50*a*; snap-fitting the male connector element 53 of the auxiliary wrench extension 50*a* into the female connector opening 3 of the ninety-degree connector 1*a*, such that the ball bearings 54 snap into the respective depressions 4 inside the female connector opening 3; snap-fitting the male connector element 5 of the ninety-degree connector 1*a* into the socket 52*a* of the auxiliary wrench extension 50*b*, such that the ball bearings 6 snap into respective depressions (not shown) in the socket 52*a*; snap-fitting the male connector element 53 of the auxiliary wrench extension 50*b* into the female connector opening 3 of the ninety-degree connector 1*b*, such that the ball bearings 54 snap into the respective depressions 4 in the female connector opening 3; snap-fitting the male connector element 5 into the female connector element 52*a* of the auxiliary wrench extension 50*c*; and snap-fitting the male connector element 53 into the female connector element 81 of the crow foot wrench 80.

In use, the bolt 62 is inserted in the bolt receptacle 82 of the crowfoot wrench 80. Accordingly, the handle 45 of the socket wrench 44 can be grasped from the side of the bracket 63 which to the side of one of the flanges 64 thereof, to facilitate tightening and/or loosening of the bolt 62 by moving the handle 45 of the socket wrench 44 in an arcuate motion in the clockwise direction (to tighten the bolt 62) and in the counterclockwise direction (to loosen the bolt 62).

Referring next to FIGS. 10 through 16, an enhanced parallel offset connector according to yet another exemplary embodiment of the invention is generally indicated by reference numeral 100. The enhanced parallel offset connector 100 includes an elongated connector body 102, which may be generally rectangular in configuration and having chamfered or rounded corners and comprising a body upper surface 114 and a body lower surface 120. The elongated connector body 102 is substantially planar, comprising a smooth, planar body lower surface 120. A male connector element 104 extends from the body upper surface 114 of the connector body 102, adjacent to one end thereof. A male connector distal surface 106 is provided on a distal edge of the male connector element 104. The male connector element 104 typically includes at least one ball bearing 116 (one of which is shown) seated in respective ball bearing openings 116*a*. A female connector opening 112, which is typically rectangular (and more specifically square), is provided in a female connector bossing 108 and continuing through the connector body 102, adjacent to the opposite end of the connector body 102. A bossing distal surface 110 is provided on a distal edge of the female connector bossing 108, wherein the bossing distal surface 110 is preferably closer to the body upper surface 114 of the elongated connector body 102 compared to the male connector distal surface 106. The preferred embodiment provides a male connector element 104 having a height from the body upper surface 114 that is equal to the height of the female connector bossing 108, including the thickness of the elongated connector body 102. The preferred embodiment provides a form factor, which assembles a plurality of connectors 100 forming a parallel and planar beam for rotating a socket or other drive tool. Multiple depressions 122, the purpose of which will be hereinafter described, are typically provided in the respective interior surfaces of the female connector opening 112. The overall design provides a thin tool for access into and between narrow locations.

Figure 15:
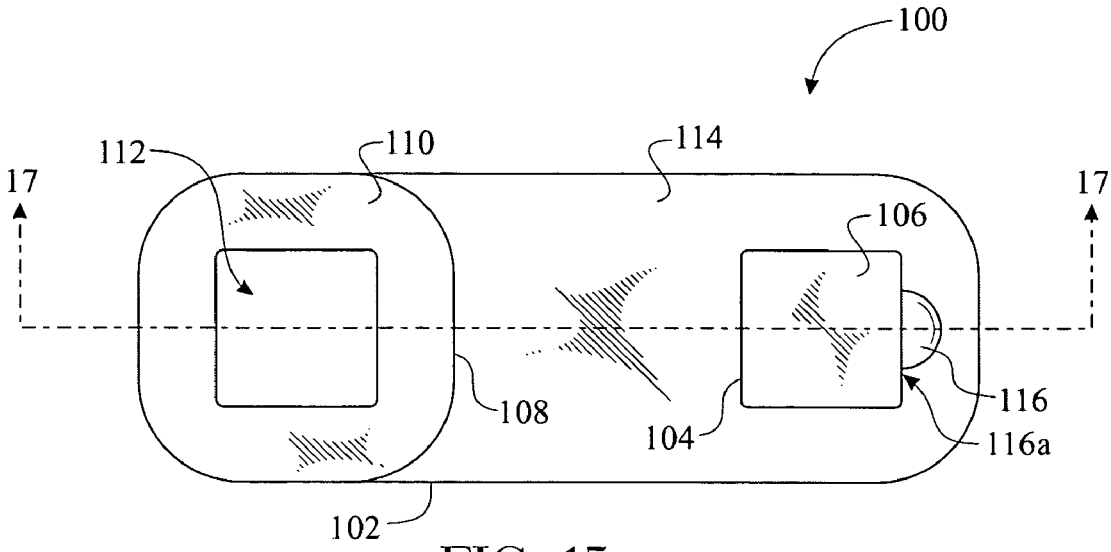
FIG. 15 is a top view of the enhanced parallel offset connector presented in FIG. 10.
Figure 16:
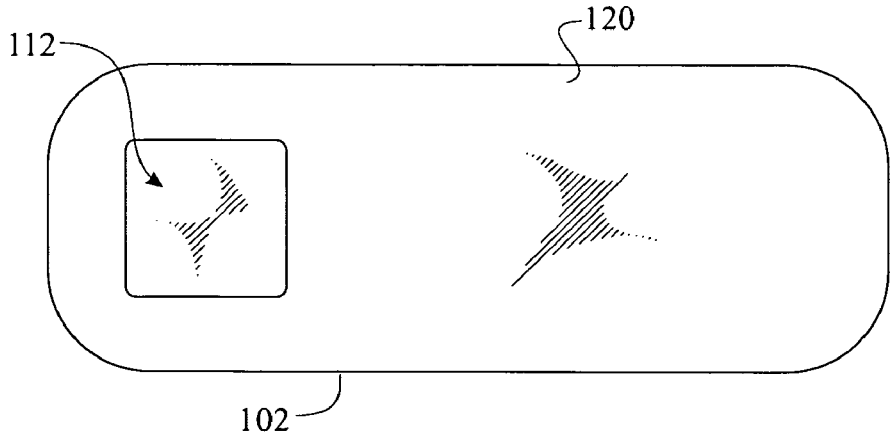
FIG. 16 is a bottom view of the enhanced parallel offset connector presented in FIG. 10.
Figure 17:
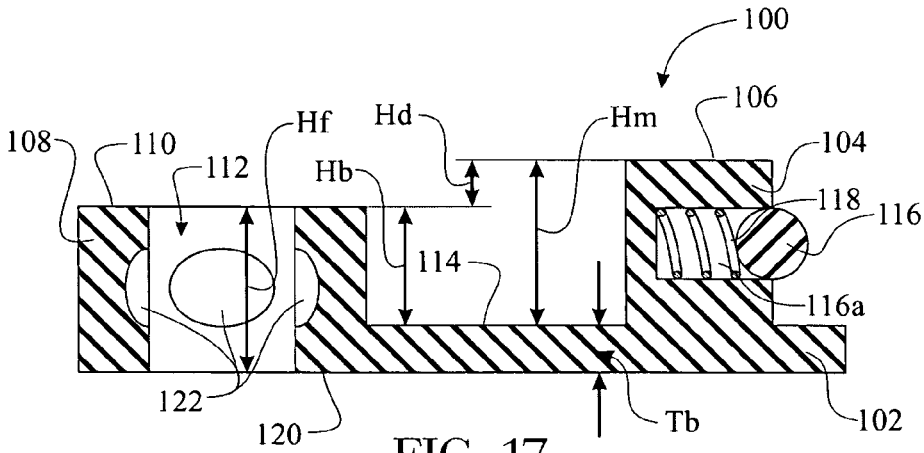
FIG. 17 is a sectioned right side elevation view of the enhanced parallel offset connector taken along section 17-17 of FIG. 15.

A cross sectional illustration of the enhanced parallel offset connector 100 taken along centered sectional line 17-17 of FIG. 15 is best shown in FIG. 17. The ball bearing 116 retracts within the 116*a* against a bearing spring 118. The bearing spring 118 can be a spiral spring (as shown), a flat spring, or of any other position returning configuration. A plurality of multiple depressions 122 is fabricated within each of the walls of the female connector opening 112. The multiple depressions 122 are positioned for receiving the ball bearing 116. The illustration additionally defines several dimensions for an improved description of the present invention. The elongated connector body 102 can be described as a planar member having a uniform thickness Tb. The male connector element 104 extends upward from the body upper surface 114 to a male height Hm. The male height Hm is generally an industry standard and respective to the socket drive size. Some examples are: For a ¼ inch drive, the Hm is approximately 0.300 inches; for a ⅜ inch drive, the Hm is approximately 0.450 inches; for a ½ inch drive, the Hm is approximately 0.850 inches. Alternately, the female connector bossing 108 extends upward from the body upper surface 114 to a height Hb. The female connector opening 112 is formed continuously through the female connector bossing 108 and the elongated connector body 102 to a dimension defined as Hf. The difference between the height Hm and the height Hb is defined as Hd. The height Hd is preferably substantially the same as the body thickness Tb; similarly, the height Hm is preferably substantially the same as the dimension Hf. The body thickness Tb is preferably between ⅕ and ⅓ of the overall height of the male height Hm.

Figure 18:
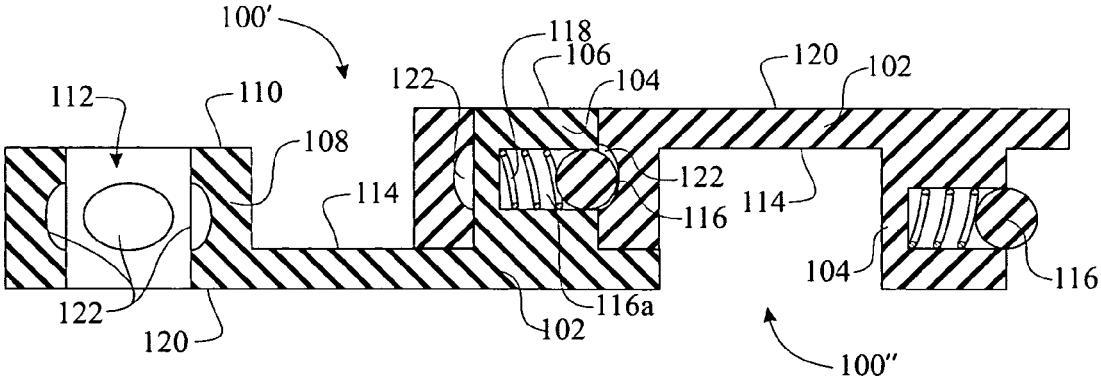
FIG. 18 is a sectioned right side elevation view illustrating the engagement of two enhanced parallel offset connectors.
Figure 19:
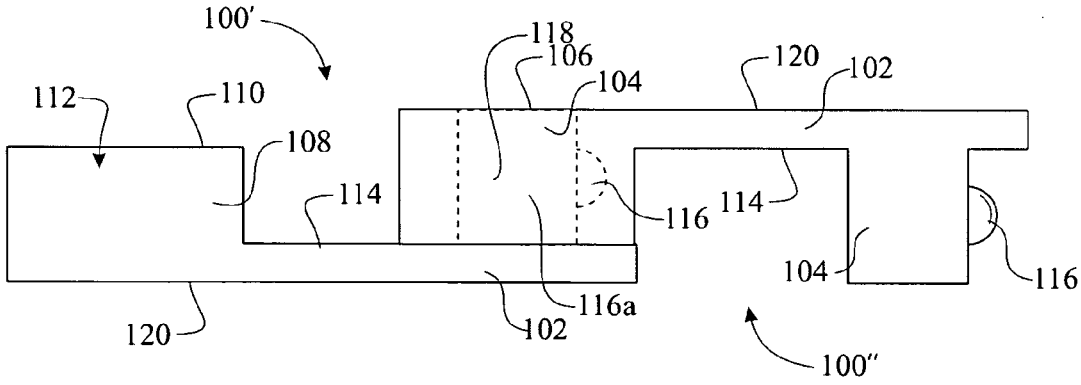
FIG. 19 is a right side elevation view illustrating the engagement of two enhanced parallel offset connectors.

Referring next to FIG. 18, an assembled pair of enhanced parallel offset connectors 100 are illustrating in a cross sectional view, such to best illustrate the engagement between the two connectors 100. An elevation view of the same is presented in FIG. 19. The male connector element 104 of a first connector 100' is inserted into the female connector opening 112 of the second connector 100". The ball bearing

116 retracts into the ball bearing opening 116*a*, against forces provided via the bearing spring 118. Upon complete insertion, the ball bearing 116 engages with the respective multiple depressions 122.

Figure 20:
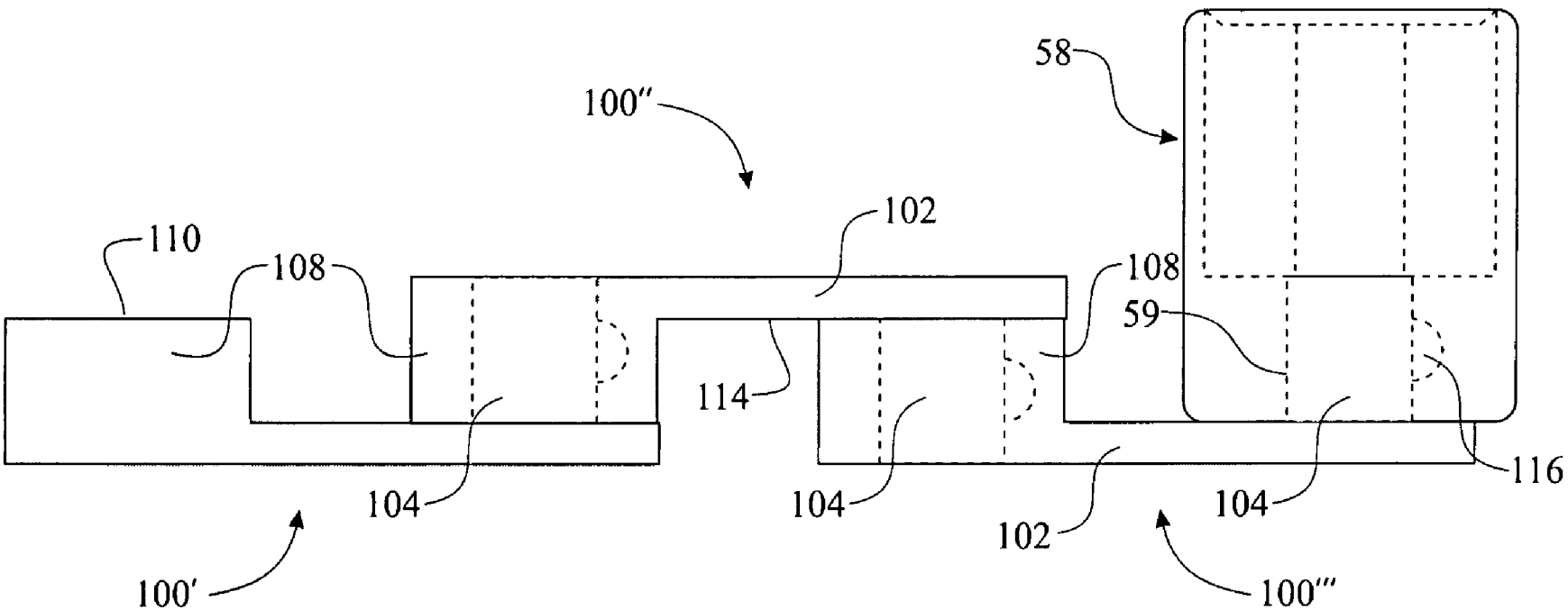
FIG. 20 is a right side elevation view illustrating the engagement of two enhanced parallel offset connectors further incorporating a socket.

Referring next to FIG. 20, a series of enhanced parallel offset connectors 100 are illustrated as in use. A first connector 100' is assembled to a second connector 100", which is assembled to a third connector 100'''. A conventional socket 58 is assembled to the male connector element 104 of the third (or final) connector 100''' in the series of connectors. The female connector opening 59 of the conventional socket 58 engages with the male connector element 104 of the third connector 100''', being secured via the ball bearing 116 which engages with a depression within the female connector opening 59 similar to the depressions of the female connector opening 112. The user then engages the conventional socket 58 with a fastener head and applies a torque using the series of the enhanced parallel offset connectors 100. The user can adjust the torque by increasing or reducing the number of enhanced parallel offset connectors 100 in the series. It is recognized the conventional socket 58 can be a standard socket drive, a tool drive (such as a screwdriver, Allen head, Torx head, etc.), and the like.

The overall length of the connector affects the applicable torque. The greater the span, the greater the torque. Conversely, the longer the span, the more limiting in application due to spatial constraints. The series of connectors 100 can be provided having differing spans, wherein when interconnected, the series provides a multitude of total lengths. The span is defined as the distance between the center of the male connector element 104 and the female connector opening 112. Providing a series of connectors 100 give the user the ability to create a single torque handle of a variety of lengths to optimize the handle for the specific application. The spans can differ by ⅛ inch, ¼ inch, ½ inch, ¾ inch, 1 inch, or any other dimension. An exemplary series provides a kit of three connectors 100, each having a span of ¾ inch, 1 inch, and 1¼ inch. A second exemplary series provides a kit of three connectors 100, each having a span of 1 inch, 1½ inch, and 2 inch. A third exemplary series provides a kit of three connectors 100, each having a span of 1 inch, 2 inch, and 3 inch.

The following provides several tables illustrating the effective length provided by a set (or plurality of sets) of connectors 100:

TABLE 1

Span Variations Using One (1) Set of Three (3) Connectors

| Span | | 1st Set | | |
|---|---|---|---|---|
| Size | Increment | ¾ | 1 | 1 ¼ |
| ¾ | N/A | X | | |
| 1 | ¼ | | X | |
| 1¼ | ¼ | | | X |
| 1¾ | ½ | X | X | |
| 2 | ¼ | X | | X |
| 2¼ | ¼ | | X | X |
| 3 | ¾ | X | X | X |

TABLE 2

Span Variations Using Two (2) Sets of Three (3) Connectors

| Span | | 1st Set | | | 2nd Set | | |
|---|---|---|---|---|---|---|---|
| Size | Increment | ¾ | 1 | 1¼ | ¾ | 1 | 1¼ |
| ¾ | N/A | X | | | | | |
| 1 | ¼ | | X | | | | |
| 1¼ | ¼ | | | X | | | |
| 1½ | ¼ | X | | | X | | |
| 1¾ | ¼ | X | X | | | | |
| 2 | ¼ | X | | X | | | |
| 2¼ | ¼ | | X | X | | | |
| 2½ | ¼ | X | X | | X | | |
| 2¾ | ¼ | X | X | | | X | |
| 3 | ¼ | X | X | X | | | |
| 3¼ | ¼ | | X | X | | X | |
| 3½ | ¼ | | X | X | | | X |
| 3¾ | ¼ | X | X | X | X | | |
| 4 | ¼ | X | X | X | | X | |
| 4¼ | ¼ | X | X | X | | | X |
| 4½ | ¼ | | X | X | | X | X |
| 4¾ | ¼ | | X | X | | X | X |
| 5 | ¼ | X | X | X | X | | X |
| 5¼ | ¼ | X | X | X | | X | X |
| 6 | ¾ | X | X | X | X | X | X |

TABLE 3

Span Variations Using Three (3) Sets of Three (3) Connectors

| Span | | 1st Set | | | 2nd Set | | | 3rd Set | | |
|---|---|---|---|---|---|---|---|---|---|---|
| Size | Increment | ¾ | 1 | 1¼ | ¾ | 1 | 1¼ | ¾ | 1 | 1¼ |
| ¾ | N/A | X | | | | | | | | |
| 1 | ¼ | X | | | | | | | | |
| 1¼ | ¼ | | X | | | | | | | |
| 1½ | ¼ | X | | | X | | | | | |
| 1¾ | ¼ | X | X | | | | | | | |
| 2 | ¼ | X | | X | | | | | | |
| 2¼ | ¼ | | X | X | | | | | | |
| 2½ | ¼ | X | X | | X | | | | | |
| 2¾ | ¼ | X | X | | | X | | | | |
| 3 | ¼ | X | X | X | | | | | | |
| 3¼ | ¼ | | X | X | | X | | | | |
| 3½ | ¼ | | X | X | | | X | | | |
| 3¾ | ¼ | X | X | X | X | | | | | |
| 4 | ¼ | X | X | X | | X | | | | |
| 4¼ | ¼ | X | X | X | | | X | | | |
| 4½ | ¼ | | X | X | | X | X | | | |
| 4¾ | ¼ | | X | X | | X | X | | | |
| 5 | ¼ | X | X | X | X | | X | | | |
| 5¼ | ¼ | X | X | X | | X | X | | | |
| 5½ | ¼ | X | X | X | X | X | | X | | |
| 5¾ | ¼ | X | X | X | X | X | | | X | |
| 6 | ¼ | X | X | X | X | X | X | | | |
| 6¼ | ¼ | X | X | X | | X | X | | X | |
| 6½ | ¼ | X | X | X | | X | X | | | X |
| 6¾ | ¼ | X | X | X | X | X | X | X | | |
| 7 | ¼ | X | X | X | X | X | X | | X | |
| 7¼ | ¼ | X | X | X | X | X | X | | | X |
| 7½ | ¼ | X | X | X | | X | X | | X | X |
| 7¾ | ¼ | X | X | X | X | X | X | X | X | |
| 8 | ¼ | X | X | X | X | X | X | X | | X |
| 8¼ | ¼ | X | X | X | X | X | X | | X | X |
| 9 | ¾ | X | X | X | X | X | X | X | X | X |

Figure 21:
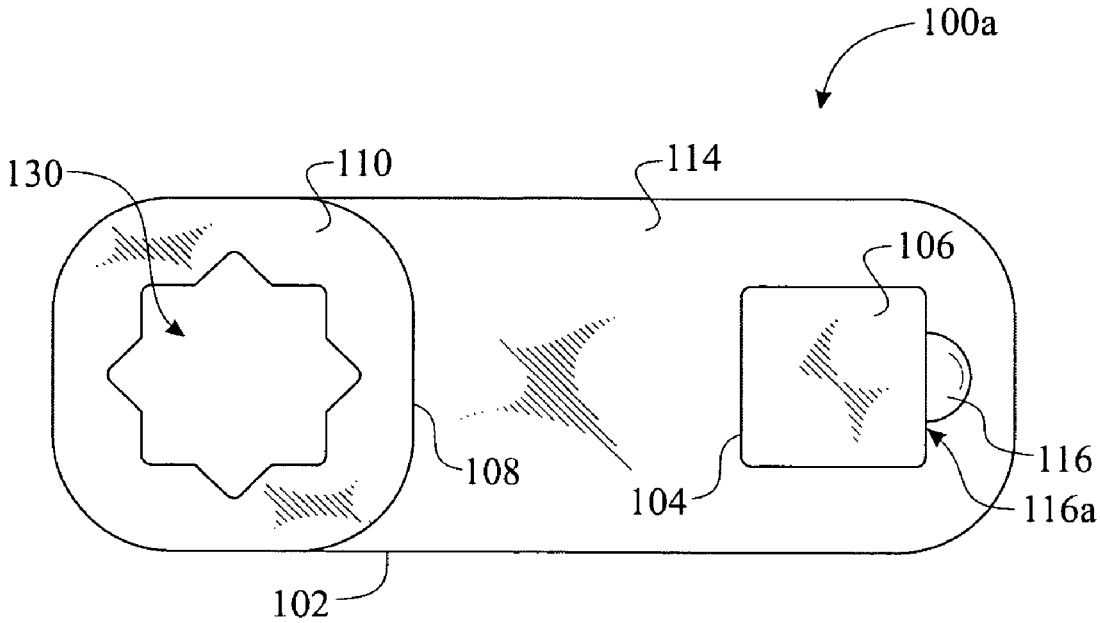
FIG. 21 is a top view of the enhanced parallel offset connector comprising a dual position interface.
Figure 22:
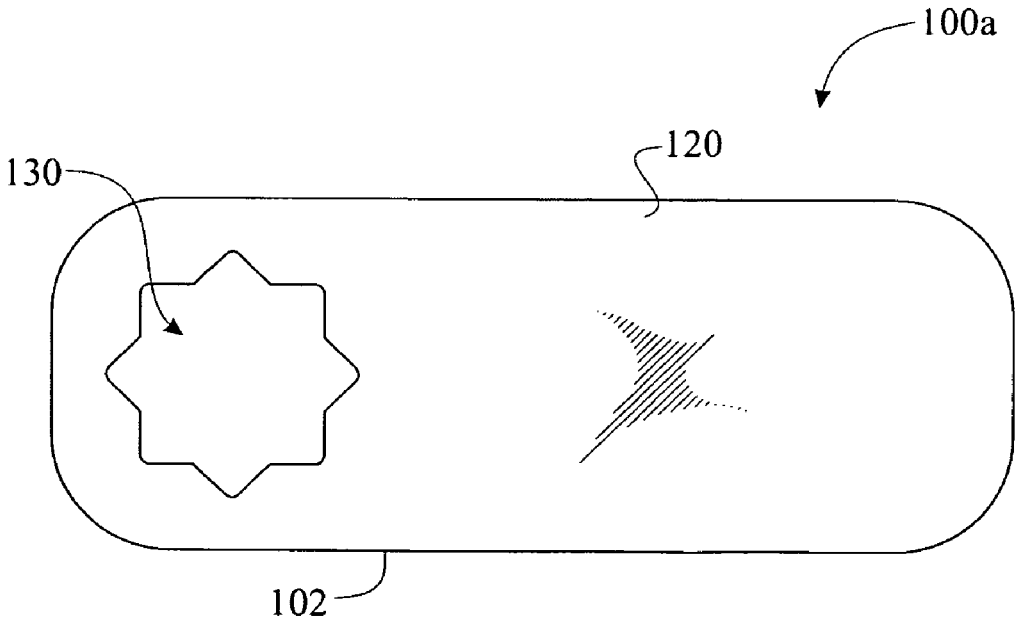
FIG. 22 is a bottom view of the enhanced parallel offset connector of FIG. 21.
Figure 23:
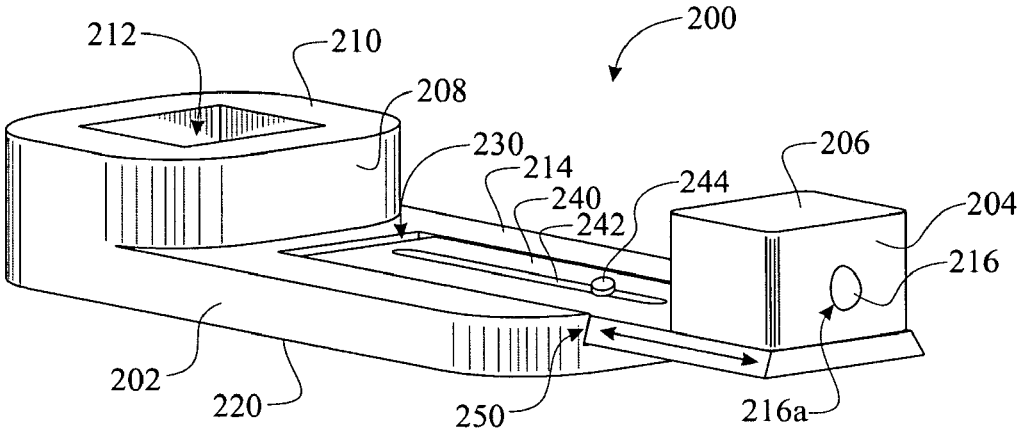
FIG. 23 is a perspective view of an exemplary embodiment of a parallel offset connector comprising a span that is slidably adjustable, shown in a retracted configuration.
Figure 24:
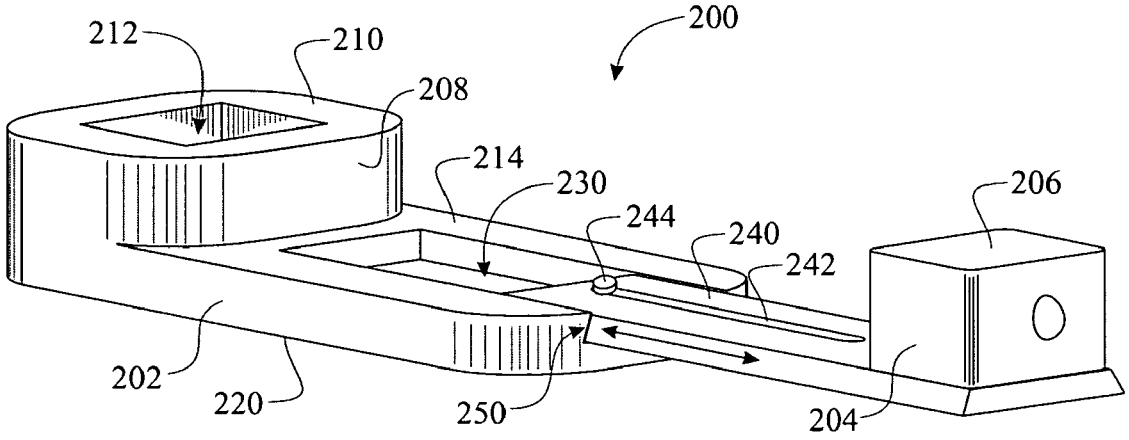
FIG. 24 is a perspective view of the parallel offset connector shown in FIG. 22, shown in an extended configuration.
Figure 25:
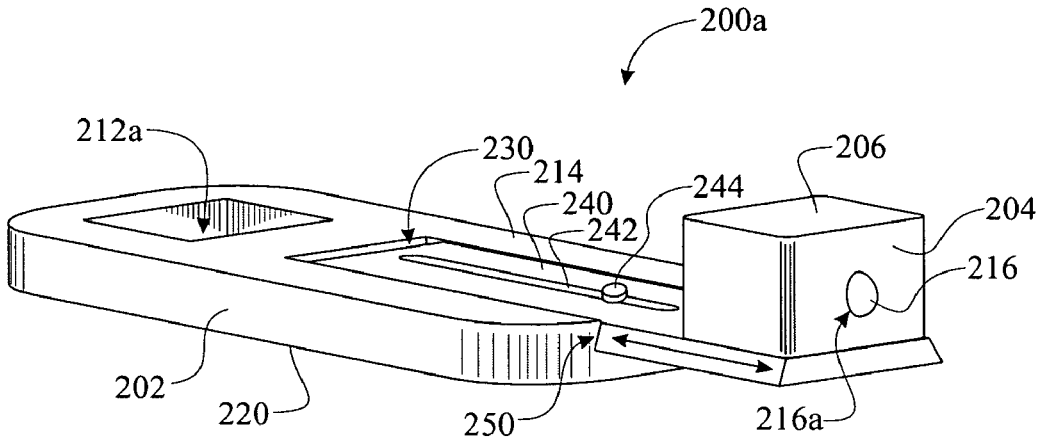
FIG. 25 is a perspective view of an exemplary embodiment of an alternate parallel offset connector comprising a span that is slidably adjustable, shown in a retracted configuration.
Figure 26:
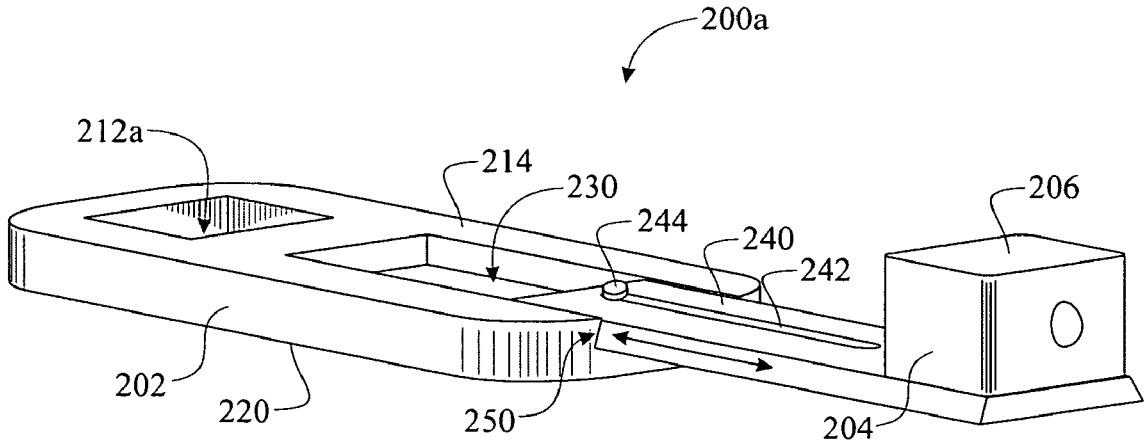
FIG. 26 is a perspective view of the parallel offset connector shown in FIG. 25, shown in an extended configuration.
Figure 27:
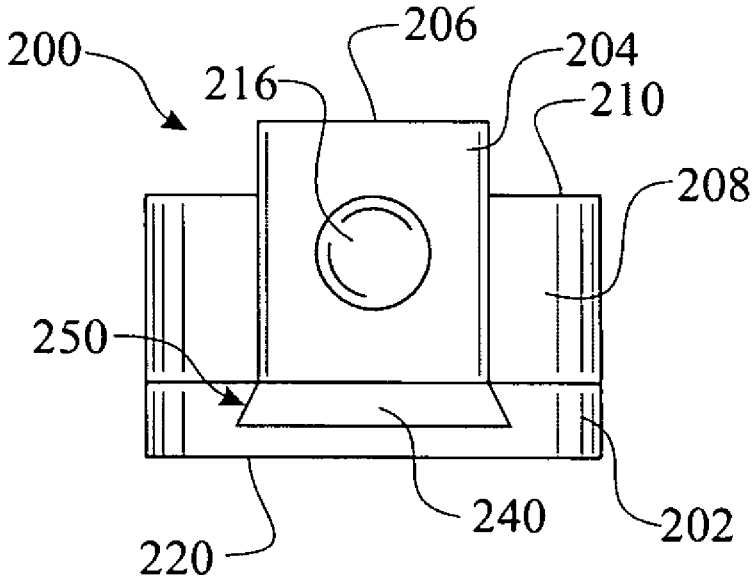
FIG. 27 is a front view of the parallel offset connector shown in FIG. 22.
Figure 28:
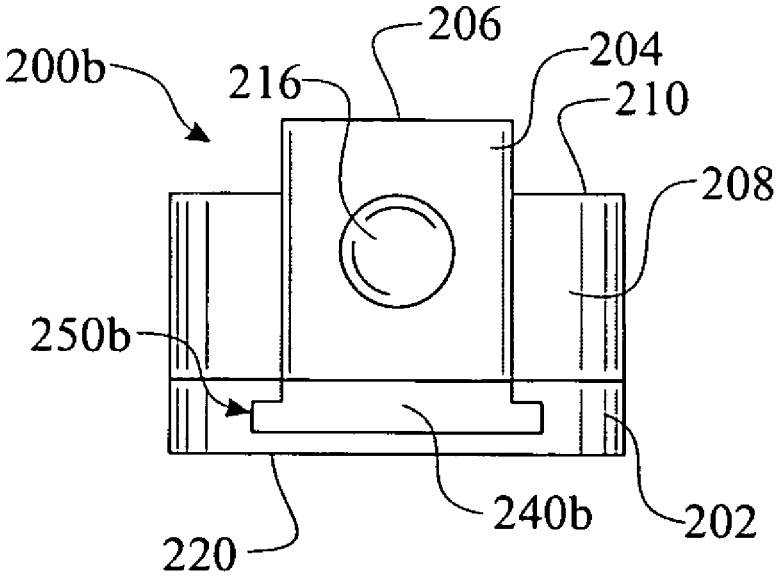
FIG. 28 is a front view of the parallel offset connector shown in FIG. 22 having an alternate slide interface configuration.

Referring next to FIGS. 21 and 22, an enhanced parallel offset connector according to yet another exemplary embodiment of the invention is generally indicated by reference numeral 100*a*. A top view is presented in FIG. 21 and a respective bottom view is presented in FIG. 22. The enhanced connector 100*a* utilizes a eight position female connector opening 130 having eight (8) points compared to the female connector opening 112 which has four (4) points. This form factor provides for a 45-degree angle connection between two engaged connectors 100*a*. It is recognized this modification can be applied to all embodiments presented herein.

Referring next to FIGS. 23 through 28, an adjustable span parallel offset connector according to yet several other exemplary embodiments of the invention are generally indicated by reference numeral 200. The adjustable span parallel offset connector 200 includes an elongated connector body 202, which may be generally rectangular in configuration and having chamfered or rounded corners, comprising a body upper surface 214 and a body lower surface 220, and incorporating an elongated slot 230. A male connector element 204 extends from an elongated sliding connector body 240, adjacent to one end thereof. The elongated sliding connector body 240 slideably engages with the elongated slot 230 of the elongated connector body 202 providing an adjustable span between the female connector opening 212 and the male connector element 204. The interface can be of any form factor, preferably having features controlling a lateral motion as well as any rotational motion about any potential axis, thus limiting the motion to being one of sliding along a longitudinal axis. The illustrated form factors include a dovetail interface 250, a tongue and groove design 250*b* (FIG. 28), and the like. A slide locking slot 242 can be disposed within the elongated sliding connector body 240 providing a means for securing the sliding elongated sliding connector body 240 in a position respective to the elongated connector body 202. A locking fastener 244 can be utilized for locking the elongated sliding connector body 240 in position. The locking fastener 244 would be tightened, applying a locking force. It is understood other locking form factors can be utilized, as any known by those skilled in the art. A male connector distal surface 206 is provided on a distal edge of the male connector element 204. The male connector element 204 typically includes at least one ball bearing 216 (one of which is shown) seated in respective ball bearing openings 216*a*. A female connector opening 212, which is typically rectangular (and more specifically square), is provided in a female connector bossing 208 and continuing through the connector body 202, adjacent to the opposite end of the connector body 202. A bossing distal surface 210 is provided on a distal edge of the female connector bossing 208, wherein the bossing distal surface 210 is preferably closer to the body upper surface 214 of the elongated connector body 202 compared to the male connector distal surface 206. The adjustable span parallel offset connector 200 can optionally eliminate the female connector bossing 208 as presented in the adjustable span parallel offset connector 200*a* presented in FIGS. 25 and 26.

While the preferred embodiments of the invention have been described above, it will be recognized and understood that various modifications can be made in the invention and the appended claims are intended to cover all such modifications which may fall within the spirit and scope of the invention.

I claim:

1. An offset socket connector, the connector comprising:

an elongated planar body defined by a first end, a second end, an upper surface, a lower surface and a uniform thickness Tb;

a male connector element extending from the upper surface of the elongated planar body adjacent the first end, the male connector element having a height Hm;

the male connector having a male connector distal surface, wherein a male connector distal surface extends beyond the bossing distal surface by a distance that is substantially equal to the thickness of the elongated planar body Tb;

a female connector opening provided through said elongated planar body adjacent the second end;

a female connector bossing extending from the upper surface of the elongated planar body and completely surrounding the female connector opening, such that the bossing defines a continuation of the female connector opening, the female connector bossing having a bossing distal surface; and the lower surface is substantially planar.

2. An offset socket connector as recited in claim 1, the connector further comprising a ball bearing moveably disposed in the male connector element.

3. An offset socket connector as recited in claim 1, the connector further comprising a slideable interface between the male connector element and the female connector opening.

4. An offset socket connector as recited in claim 3, the slideable interface having features controlling a lateral motion and a rotational motion about any potential axis, limiting the motion to a sliding motion along a longitudinal axis.

5. An offset socket connector, the connector comprising:

an elongated planar body defined by a first end, a second end, an upper surface, a lower surface and a uniform thickness Tb;

a male connector element extending from the upper surface of the elongated planar body adjacent the first end, the male connector element having a generally square cross sectional shape and a height Hm;

the male connector having a male connector distal surface, wherein a male connector distal surface extends beyond the bossing distal surface by a distance that is substantially equal to the thickness of the elongated planar body Tb;

a female connector opening provided through said elongated planar body adjacent the second end, the female connector opening being a generally square shaped aperture;

a female connector bossing extending from the upper surface of the elongated planar body and completely surrounding the female connector opening, such that the bossing defines a continuation of the female connector opening, the female connector bossing having a bossing distal surface; and the lower surface is substantially planar.

6. An offset socket connector as recited in claim 5, the female connector opening having a second generally square shaped aperture superimposed about and oriented at a 45-degree angle to the first generally square shaped aperture.

7. An offset socket connector as recited in claim 5, the connector further comprising a ball bearing moveably disposed in the male connector element.

8. An offset socket connector as recited in claim 5, the connector further comprising a slideable interface between the male connector element and the female connector opening.

9. An offset socket connector as recited in claim 8, the slideable interface having features controlling a lateral motion and a rotational motion about any potential axis, limiting the motion to a sliding motion along a longitudinal axis.

10. An offset socket connector, the connector comprising:

an elongated body having an upper surface, a lower surface, and a elongated slot extending substantially parallel to the elongated body through at least one end;

an elongated sliding connector body slidably disposed within the elongated slot providing a slideable interface;

a male connector element extending from the elongated sliding connector body adjacent a first end;

a female connector opening disposed through said elongated planar body adjacent an opposing end; and a slide locking mechanism temporarily securing the elongated sliding connector body in position respective to the elongated body.

11. An offset socket connector as recited in claim 10, the slideable interface having features controlling a lateral motion and a rotational motion about any potential axis, limiting the motion to a sliding motion along a longitudinal axis.

12. An offset socket connector as recited in claim 11, wherein the slideable interface comprising at least one of:

a. a dovetail configuration, and b. a tongue and groove configuration.

13. An offset socket connector as recited in claim 11, the connector further defined via the male connector element having a generally square cross sectional shape; and the female connector opening being a generally square shaped aperture.

14. An offset socket connector as recited in claim 13, the female connector opening having a second generally square shaped aperture superimposed about and oriented at a 45-degree angle to the first the first generally square shaped aperture.

* * * * *